US005195453A

United States Patent [19]

McGibbon, II

[11] Patent Number: 5,195,453

[45] Date of Patent: Mar. 23, 1993

[54] TRAFFIC CONE INSERT

[76] Inventor: David A. McGibbon, II, P.O. Box 1543, San Ramon, Calif. 94583

[21] Appl. No.: 822,112

[22] Filed: Jan. 17, 1992

[51] Int. Cl.[5] ..... E01F 9/10

[52] U.S. Cl. ..... 116/63 C; 116/63 P; 16/121

[58] Field of Search ..... 116/63 P, 63 C, 63 T; 16/110 R, 121, 124; 40/612; 340/908, 908.1; 404/6, 9, 10, 11

[56] References Cited

U.S. PATENT DOCUMENTS

| | | | |
|---|---|---|---|
| 2,762,328 | 9/1956 | Weig | 116/63 C |
| 2,949,531 | 8/1960 | Lemelson | 340/908.1 X |
| 3,380,428 | 4/1968 | Abrams | 116/63 C |
| 3,386,409 | 6/1968 | Dawson | 116/63 C |
| 3,732,842 | 5/1973 | Vara, Sr. | 116/63 C |
| 4,197,808 | 4/1980 | Kinninger | 116/63 C |
| 5,036,791 | 8/1991 | Thurston | 116/63 C |

FOREIGN PATENT DOCUMENTS

| | | | |
|---|---|---|---|
| 0665785 | 1/1952 | United Kingdom | 116/63 C |
| 2039354 | 8/1980 | United Kingdom | 340/114 R |

*Primary Examiner*—William A. Cuchlinski, Jr.
*Assistant Examiner*—W. Morris Worth
*Attorney, Agent, or Firm*—Theodore J. Bielen, Jr.

[57] ABSTRACT

An insert device for a hollow traffic cone utilizing an element having a first portion capable of lying within the hollow traffic cone and a second portion extending to the exterior of the hollow traffic cone. An intermediate portion connects the first and second portions and possesses a reduced dimension relative to the second portion of the element to permit gripping of the element by the user. The element may be wedged or fastened to the hollow traffic cone.

4 Claims, 1 Drawing Sheet

TRAFFIC CONE INSERT

BACKGROUND OF THE INVENTION

The present invention to a novel traffic cone structure.

Control of traffic often requires rerouting of vehicles to permit usage of the roadway for non-traffic activities. For example, repair and alteration of the roadway, pedestrian traffic, natural disasters such as flooding, and other such items require a deviation from the normal traffic pattern on a roadway. In the past, traffic cones or guides of a temporary nature have been placed by the pertinent authorities of roadways to effect such traffic changes. Such traffic guides or markers are generally high visibility posts that extend from a weighted base. The typical marker is formed from a flexible, hollow, truncated conical body. Such traffic cones are relatively light in weight and stackable. Unfortunately, it is not very simple to recover traffic cones after usage since they are difficult to gather and restack. Consequently traffic cones are often abandoned by work crews which constitutes a great waste that can prove expensive.

Traffic markers such as those found in U.S. Pat. No. 2,762,328 and 3,380,428 show traffic light post which include gripping slots at the top portion to aid the user in grasping the traffic marker. U.S. Pat. No. 5,036,791 shows a graspable traffic marker of slim rectangular configuration which is stackable since a slot is molded into the top portion of the rectangular posts.

A traffic cone which is easily grippable by the user and is stackable for compact storage would be a notable advance in the field of traffic control.

SUMMARY OF THE INVENTION

In accordance with the present invention a novel and useful traffic cone utilizing an insert device is herein provided.

The traffic cone of the present invention uses a hollow body which is in the form of a truncated cone having a large end as a base and a small end forming the top of the same. Such traffic cone is generally formed of a flexible plastic type material.

To permit handling of the traffic cone, the present invention proposes the addition of an element connected to the traffic cone or formed as an insert to the hollow body. The element includes a first portion capable of wedging within the hollow traffic cone or connected to the small end of the traffic cone. The first portion may be provided with a plurality of flanges or legs which engage the interior of the hollow traffic cone. The first portion may also be fastened to the interior of the traffic cone by the use of glue or mastic, or other fasteners such as staples or rivets.

A second portion of the element or extension member reaches outwardly from the exterior of the traffic cone, specifically at the small end thereof. The second portion would have an exterior overall transverse dimension which would permit passage of the second portion of the element through the small end of the hollow traffic cone. Such dimension may be less than the interior dimension of the small end of the hollow traffic cone or be slightly larger than the same but would be able to pass through the cone due to the flexibility of the material of the traffic cone. The second portion may have a flattened or rounded top.

The element is also constructed with an intermediate portion connecting the first and second portions. The intermediate portion possesses a reduced exterior dimension relative to the second portion of the element to permit gripping of the element at any place around the cone at the second portion of the element. Thus, the traffic cone may be turned around its axis and be grippable at any angle.

Means is also provided in the present invention for holding the element to the traffic cone when the same is not unitarily formed with the traffic cone. Such means may take the form of a mastic or other fasteners, as has been previously described.

It may be apparent that a novel and useful traffic cone device has been described.

It is therefore an object of the present invention to provide an insert device for a hollow traffic cone which is easily connected to the traffic cone for relatively permanent use therewith and permits the user of the traffic cone to easily grip the traffic cone for the purpose of setting out and recovering of the same.

Another object of the present invention is to provide a novel traffic cone which uses an insert having a portion which extends from the body of the traffic cone and includes a portion of reduced dimension permitting gripping of the traffic at any place around the top of the traffic cone.

Yet another object of the present invention is to provide a novel traffic cone device which includes a gripping element at the top of the small portion of the traffic cone and also permits stacking of similar traffic cones for compact storage.

A further object of the present invention is to provide a novel traffic cone device which employs an insert that converts an existing traffic cone into one which is easily grippable during usage.

Another object of the present invention is to provide a novel traffic cone device which saves a great expenditure of labor and money through easy deployment and recovery of such traffic cone device.

The invention possesses other objects and advantages especially as concerns particular characteristics and features thereof which will become apparent as the specification continues.

Reference is made to the following detailed description of the preferred embodiments thereof which should be taken in conjunction with the prior described drawings.

DESCRIPTION OF THE PREFERRED EMBODIMENTS

Various aspects of the present invention will evolve from the following detailed description of the preferred embodiments which should be referenced to the previously described drawings.

Figure 2:
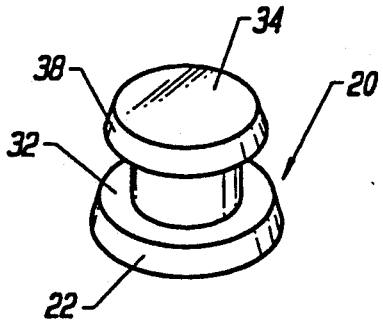
FIG. 2 is a top front perspective view of the insert device of the present invention.
Figure 1:
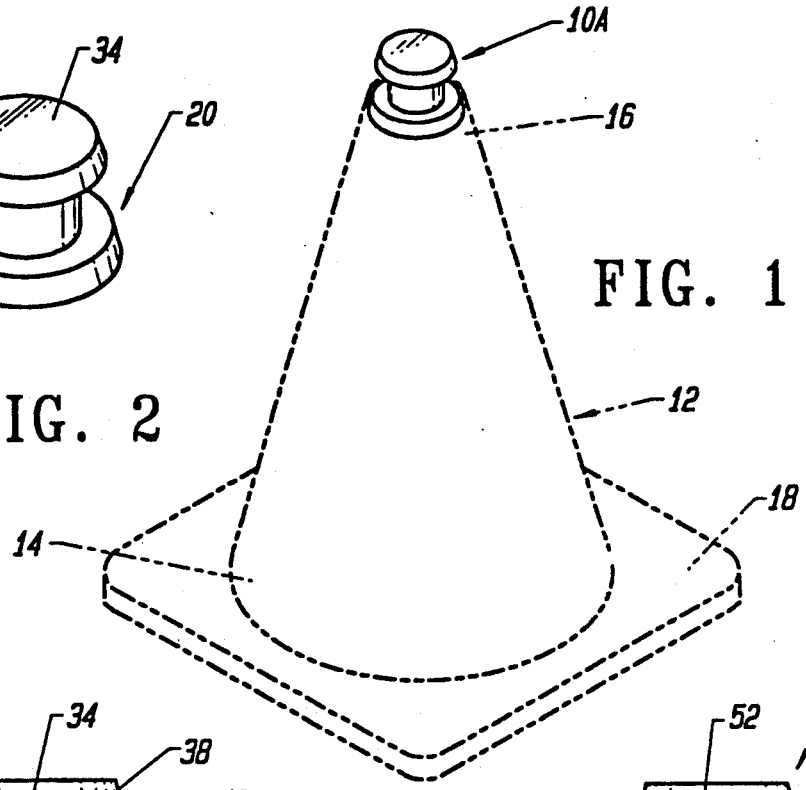
FIG. 1 is a top right perspective view of a conventional traffic cone used with the insert device of the present invention.
Figure 3:
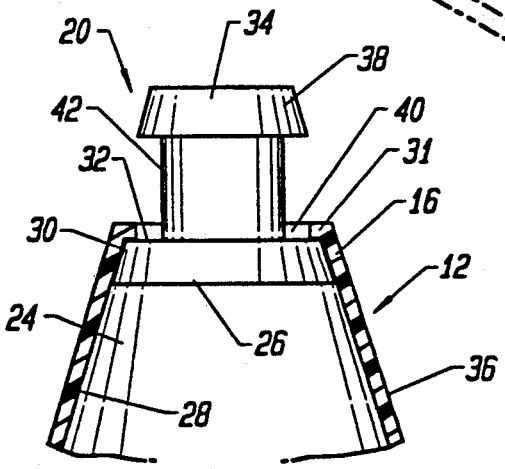
FIG. 3 is a front elevational view of the insert device of the present invention shown within a traffic cone depicted in section.

The invention as a whole is shown in the drawings by reference character 10 followed by an upper case letter depicting various embodiments of the same. The insert device 10A, FIGS. 1-3 is shown in FIG. 1 as being placed in a conventional traffic cone 12. Insert device 10A may also be formed integrally with a newly manufactured traffic cone. Traffic cone 12 includes a large end 14 and a small end 16. Traffic cone 12 is a hollow body usually formed of plastic, rubber, or other flexible material. Base 18 stabilizes cone 12 when in use.

Insert device 10A includes an element 20 formed of material similar to that of traffic cone 12. Element 20 includes a first portion 22 which is capable of lying within hollow traffic cone 12. First portion 22 extends to the small end 16 of traffic cone 12 but remains within chamber 24 of traffic cone 12, FIG. 3. As depicted in the drawings, first portion 22 is itself a truncated cone of solid configuration. Lateral surface 26 of element 20 wedges against inner surface 28 of traffic cone 12. Glue or mastic layer 30 may aid in the holding or fixing of first portion 22 to the inner surface 28 of traffic cone 12, however other fasteners such as rivets, clips, and the like may be employed in this regard. It should be noted that traffic cone 12 includes a lip 31 which overlaps the top surface 32 of first portion 22, to help support first portion 22 of element 20 in the position depicted in FIG. 3.

Element 20 is also constructed with a second portion 34 which extends from the exterior surface 36 of traffic cone 12. Second portion 34 possesses a side surface 38 which is in the shape of a truncated cone substantially matching the angle of the truncated cone constituting traffic cone 12. Although depicted in the drawing as being slightly larger, side portion 38 may slip through top opening 40 since con 12 is somewhat flexible. It should be noted that second portion 34 may be sized smaller to pass through opening 40 of traffic cone 12 without stretching the same.

Element 20 further possesses an intermediate portion 42 which connects first portion 22 and second portion 34 of element 20. Intermediate portion 42 possesses a reduced exterior dimension, in the present case a reduced diameter, relative to second portion 34. Intermediate portion also extends from exterior portion 36 of traffic cone 12 to a certain degree. Thus, the combination of intermediate portion 42 and second portion 34 produces a convenient gripping area for the hand of a user permitting the user to lift and carry device 10A with ease.

Figure 4:
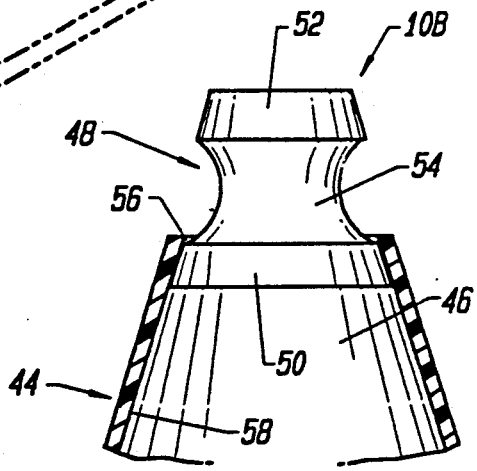
FIG. 4 is a front elevational view of another embodiment of the device of the present invention in place within a traffic cone of conventional configuration shown in section.

Referring now to FIG. 4, it may be observed that a hollow traffic cone 44 constructed of material similar to traffic cone 12 is shown in section. Device 10B can be inserted to the interior 46 of traffic cone 44 in a manner similar to device 10A. Element 48 includes a first portion 50 and a second portion 52 which are similar in construction to first and second portions 26 and 34 of element 20 of FIG. 3. However, intermediate portion 54, although of a reduced dimension provide a gripping surface, which is curved when element 20 is viewed in section.

Traffic cone 44 also includes a narrow lip 56. Element 48 may be fastened to the interior surface 58 of traffic cone 44 or be frictionally wedged within traffic cone 44.

Figure 5:
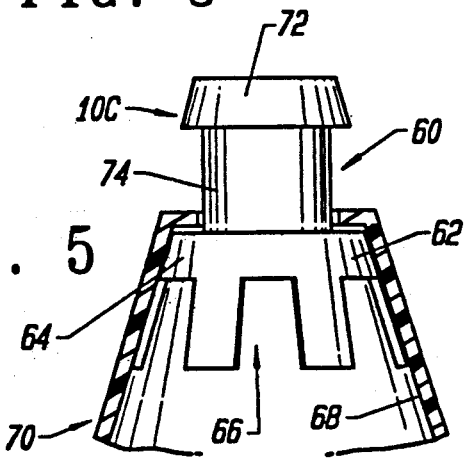
FIG. 5 is a front elevational view of a third embodiment of the present invention in place within a conventional traffic cone depicted in section.

With reference to FIG. 5, it may be observed that device 10C is shown in which an element 60 includes a first portion 62 which includes a truncated conical surface 64 formed in the same manner as outer surface 26 of portion 22 of element 20, FIG. 3. However, first portion 62 includes a plurality of flanges 66 which extend down the inner surface 68 of traffic cone 70. The plurality of flanges 66 aid in the frictional holding or wedging of element 60, although fastening means such as glue may also be employed therewith. Element 60 also includes a second portion 72 and an intermediate portion 74, which are similarly constructed to second portion 34 and intermediate portion 42 of element 20, FIG. 3.

Figure 6:
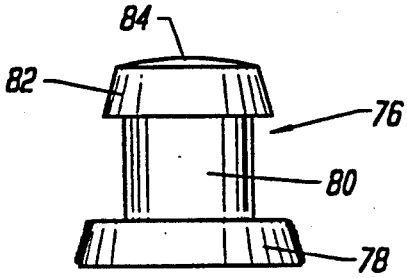
FIG. 6 is a front elevational view of a fourth embodiment of the present invention.

FIG. 6 depicts an element 76 which has a first portion 78, an intermediate portion 80, and a second portion 82. Element 76 would fit within traffic cone 12, FIGS. 1-3, in a similar manner to element 20. Second portion 82 of element 76 includes a rounded top 84.

In operation, the user may take any one of elements 20, 48, or 60 and insert the same within a conventional traffic cone, such as traffic cone 12. Elements 20, 48, or 60 would then wedge to the interior walls, such as wall 28, of the conventional traffic cone 12 and be held to the same by friction or by the use of fastening means such as mastic layer 30. The finished device 10A, 10B, or 10C would then be easily transportable to and from the site of use since element 20, 48, or 60 provides a convenient gripping portion for the user.

While in foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An insert device for a hollow traffic cone having a small end and a large end comprising:

an element having a first truncated cone shaped portion cable of lying within the hollow traffic cone, said first portion of said element including an overall transverse dimension larger than the transverse dimension of the small end of the traffic cone so as to be wedged therein;

a second portion, said second portion having an overall transverse dimension which is less than the overall transverse dimension of said first portion to permit passage of said second portion through the small end of the hollow traffic cone; and an elongated intermediate portion connecting said first and second portions, an exterior surface of said intermediate portion being reduced in diameter relative to a diameter of said second portion of said element, said intermediate portion being capable of extending outside the hollow traffic cone so as to provide a gripping area for a hand of a user; and means for holding said element within the hollow traffic cone, said means including an outer surface of said first portion which engages an inner wall of the small end of the hollow traffic cone.

2. The device of claim 1 in which said means for holding said element to the traffic cone includes a plurality of flanges extending from said first portion, said plurality of flanges frictionally engaging the inner wall of the hollow traffic cone.

3. The device of claim 1 in which said means for holding said element to the traffic cone includes mastic between said first portion of said element and said inner wall of the hollow traffic cone.

4. The device of claim 1 in which the exterior surface of said intermediate portion is curved when viewed in section.

* * * * *